US009782031B2

(12) United States Patent
Debus

(10) Patent No.: US 9,782,031 B2
(45) Date of Patent: Oct. 10, 2017

(54) HANGER

(71) Applicant: Steven Sal Debus, Vancouver (CA)

(72) Inventor: Steven Sal Debus, Vancouver (CA)

( * ) Notice: Subject to any disclaimer, the term of this patent is extended or adjusted under 35 U.S.C. 154(b) by 0 days.

(21) Appl. No.: 14/934,513

(22) Filed: Nov. 6, 2015

(65) Prior Publication Data

US 2017/0127866 A1 May 11, 2017

(51) Int. Cl.
*A47G 25/28* (2006.01)
*A47G 25/30* (2006.01)
*A47G 25/32* (2006.01)

(52) U.S. Cl.
CPC ..... *A47G 25/28* (2013.01); *A47G 25/30* (2013.01); *A47G 25/32* (2013.01)

(58) Field of Classification Search
CPC ..... A47G 25/14; A47G 25/24; A47G 25/28; A47G 25/4015; A47G 25/482; A47G 25/34; A47G 25/36; A47G 25/30; A47G 25/32; A47F 7/19; A41D 27/22
See application file for complete search history.

(56) References Cited

U.S. PATENT DOCUMENTS 351,102 A 10/1886 Flieger
578,328 A 3/1897 Garson
2,279,777 A 4/1931 Dean
2,037,077 A 4/1936 McBride
2,045,848 A 6/1936 Geer
2,451,788 A 10/1948 Wahl
2,460,905 A 11/1949 Saunders
2,513,535 A 7/1950 Von Gunten
2,594,958 A 4/1952 Masciana
2,692,711 A 10/1954 Norris et al.
2,716,513 A * 8/1955 Braunstein ..... A47G 25/4023 223/94
2,895,657 A 7/1959 Laughton
2,912,149 A 11/1959 Stuard
2,970,725 A 2/1961 Bonaldi
D193,318 S 7/1962 Kelley
D195,017 S * 4/1963 Wilhelm
3,116,860 A * 1/1964 Urich ..... A47G 25/50 223/85
3,194,458 A 7/1965 Bennett
(Continued)

FOREIGN PATENT DOCUMENTS

JP 1094472 A 4/1998
JP 10216001 A 8/1998
(Continued)

*Primary Examiner* — Ismael Izaguirre

(57) ABSTRACT

A hanger can include a unitary bar extending between first and second opposite ends and between top and bottom surfaces. The hanger can also include a suspending member having a shank fixed to the unitary bar. The hanger can also include a first and second series of curved notches respectively disposed at the first and second opposite ends. The hanger can also include a bidirectional notch extending into the unitary bar from the bottom surface at a position between the first and second opposite ends. The bidirectional notch can extend vertically for a first predetermined distance and laterally for a second predetermined distance. An upwardly-facing surface can be defined by the bidirectional notch and is positioned lower than the first and second series of curved notches.

4 Claims, 5 Drawing Sheets

(56) References Cited

U.S. PATENT DOCUMENTS

| | | | | | |
|---|---|---|---|---|---|
| 3,307,753 | A * | 3/1967 | Levine | A47G 25/16 | 223/95 |
| 3,378,180 | A * | 4/1968 | Singer | A47G 25/28 | 223/87 |
| 5,161,720 | A | 11/1992 | Kolton et al. | | |
| D366,569 | S | 1/1996 | Coles et al. | | |
| D654,704 | S | 2/2012 | Hanson et al. | | |
| D716,563 | S | 11/2014 | Lee | | |
| 2005/0184108 | A1* | 8/2005 | Ho | A47G 25/183 | 223/85 |

FOREIGN PATENT DOCUMENTS

| | | | |
|---|---|---|---|
| JP | 2008073543 | A | 4/2008 |
| JP | 2010036005 | A | 2/2010 |
| WO | 9608988 | A1 | 3/1996 |
| WO | 2004066792 | A1 | 8/2004 |

* cited by examiner

HANGER

BACKGROUND

1. Field

The present disclosure relates to a garment hanger.

2. Description of Related Prior Art

U.S. Pat. No. 2,692,711 discloses a PANTS HANGER, The PANTS HANGER has parallel bars to extend through belt loops and a suspending hook permitting hanging of pants right-end-up and avoiding spilling of pocket contents. The principal object of the PANTS HANGER is to provide an exceptionally simple and inexpensive hanger yet one which will effectively support the pants and will aid in keeping them properly creased.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A hanger can include a unitary bar extending between first and second opposite ends and between top and bottom surfaces. The hanger can also include a suspending member having a shank fixed to the unitary bar. The hanger can also include a first and second series of curved notches respectively disposed at the first and second opposite ends. The hanger can also include a bidirectional notch extending into the unitary bar from the bottom surface at a position between the first and second opposite ends. The bidirectional notch can extend vertically for a first predetermined distance and laterally for a second predetermined distance. An upwardly-facing surface can be defined by the bidirectional notch and is positioned lower than the first and second series of curved notches.

BRIEF DESCRIPTION OF THE DRAWINGS

The detailed description set forth below references the following drawings.

DETAILED DESCRIPTION

Figure 1:
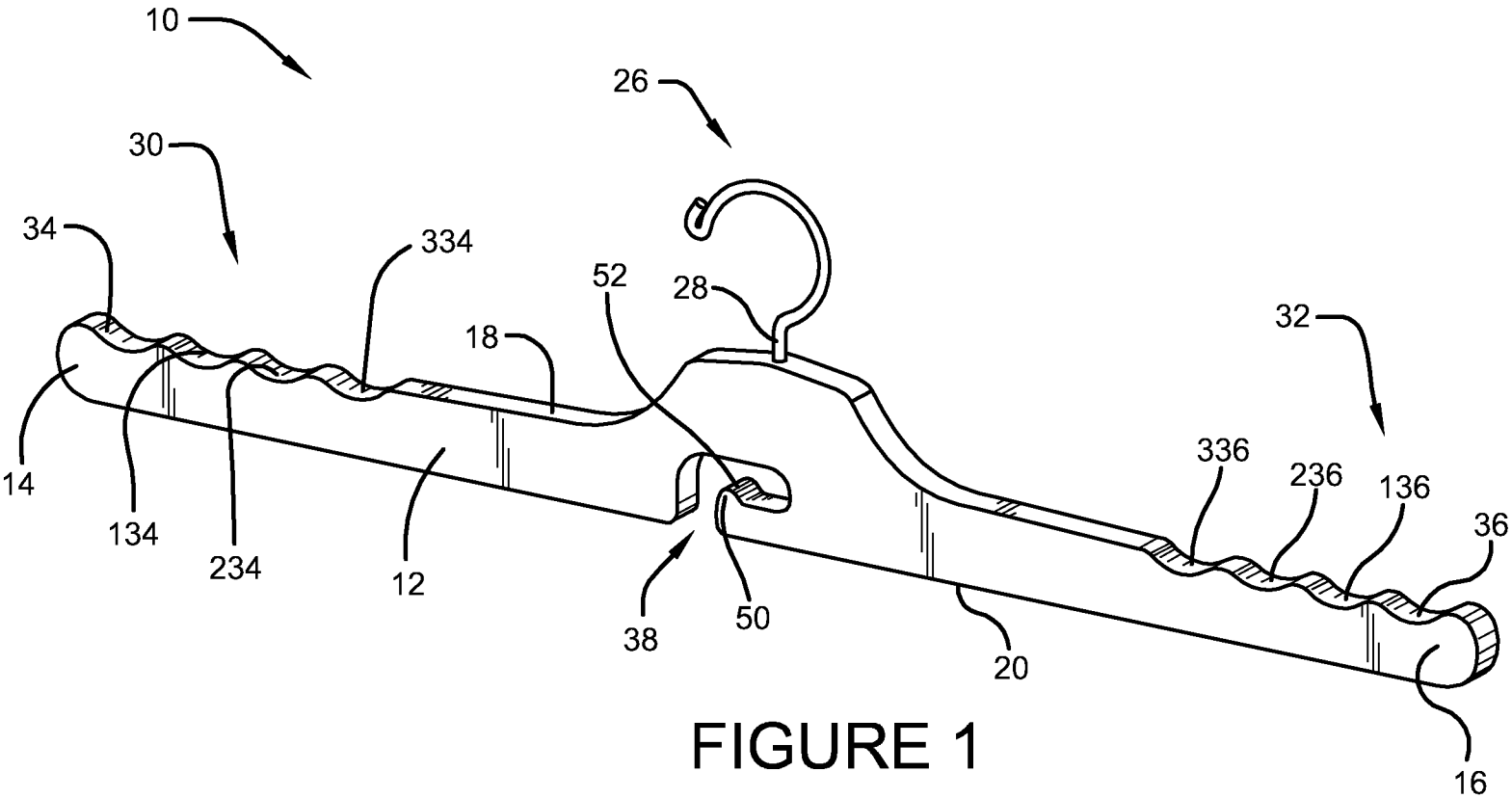
FIG. 1 is a perspective view of a hanger according to an exemplary embodiment of the present disclosure.
Figure 2:
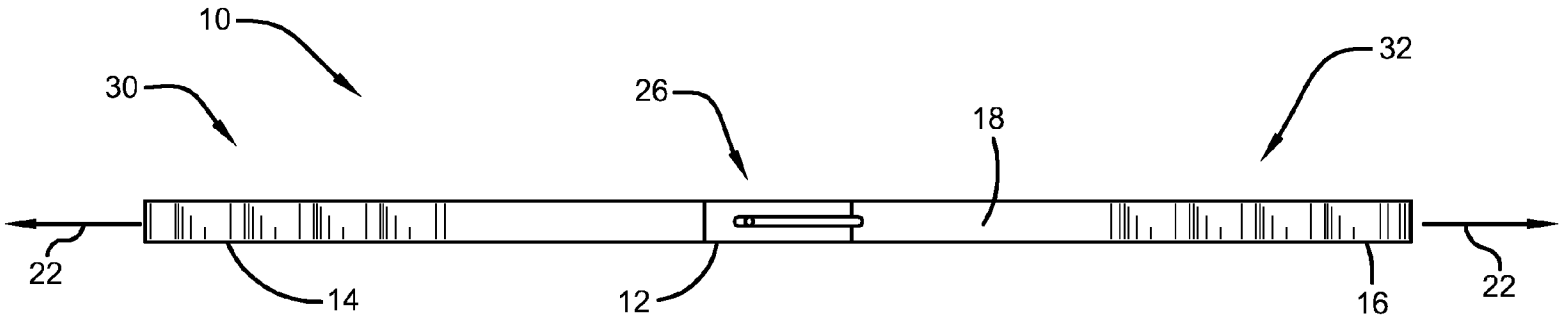
FIG. 2 is a top view of the hanger shown in FIG. 1.
Figure 3:
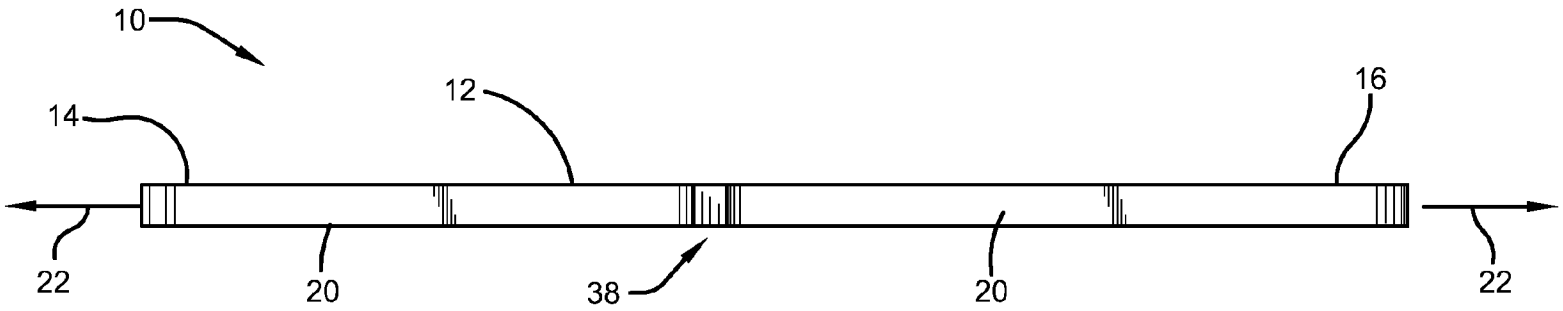
FIG. 3 is a bottom view of the hanger shown in FIGS. 1 and 2.

A plurality of different embodiments of the present disclosure is shown in the Figures of the application. Similar features are shown in the various embodiments of the present disclosure. Similar features across different embodiments have been numbered with a common reference numeral and have been differentiated by an alphabetic suffix. Similar features in a particular embodiment have been numbered with a common two-digit, base reference numeral and have been differentiated by a different leading numeral. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The present disclosure, as demonstrated by the exemplary embodiment described below, can provide hanger for hanging garments, especially pants. In an exemplary embodiment of the present disclosure, a hanger 10 can include a unitary bar 12. The unitary bar 12 can be a composite structure formed from a single material. The unitary bar 12 can extend between first and second opposite ends 14, 16 spaced from one another along a lateral or horizontal axis 22. The unitary bar 12 can also extend between top and bottom surfaces 18, 20 spaced from one another along a vertical axis 24. As shown in the Figures, the top surface 20 faces upwardly and is uncovered.

The hanger 10 can also include a suspending member 26 having a shank 28 fixed to the unitary bar 12. The hanger 10 can also include a first and second series 30, 32 of curved notches or undulations respectively disposed at the first and second opposite ends 14, 16. The first series 30 of curved notches can include curved notches or undulations 34, 134, 234, 334. The second series 32 of curved notches can include curved notches or undulations 36, 136, 236, 336. As shown in the Figures, the undulations 34-334 and 36-336 are in the top surface 20 which faces upwardly and the undulations 34-334 and 36-336 are therefore also face upwardly and are uncovered.

Figure 4:
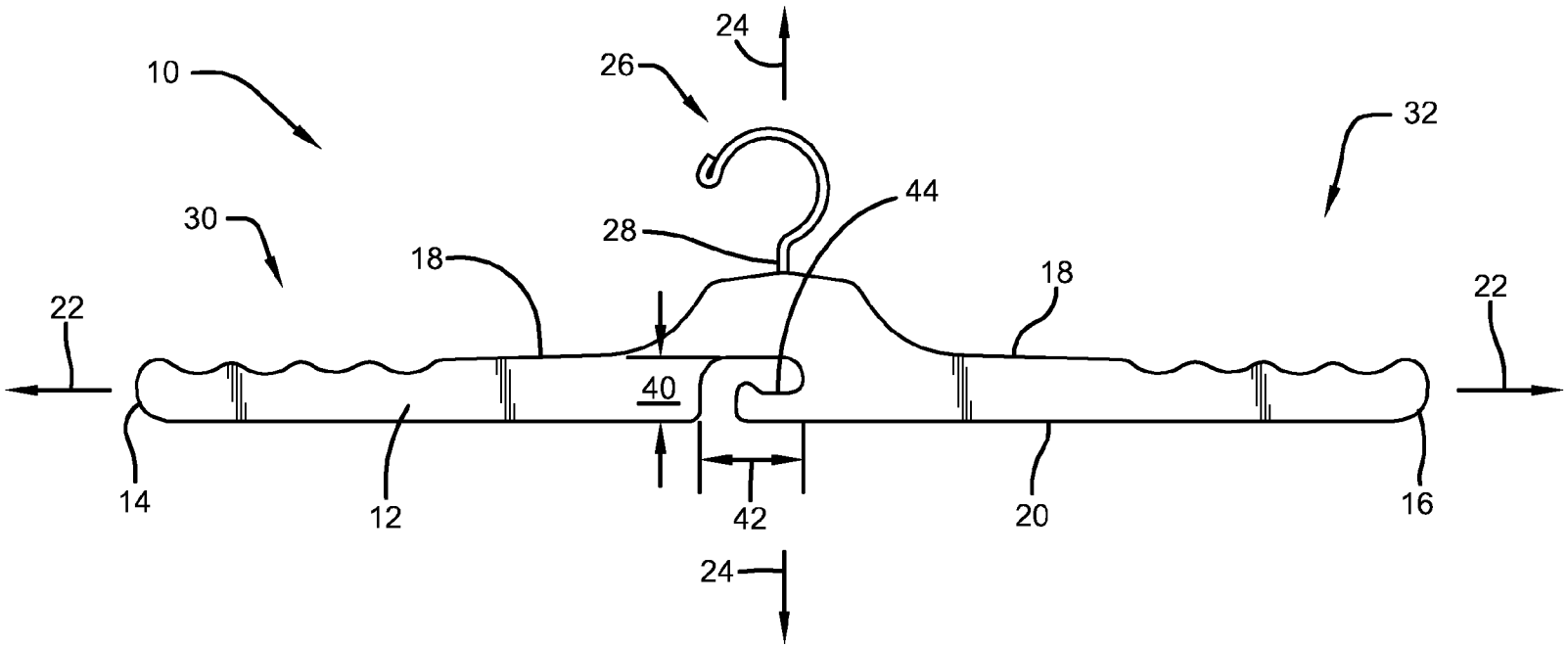
FIG. 4 is a front view of the hanger shown in FIGS. 1-3.
Figure 5:
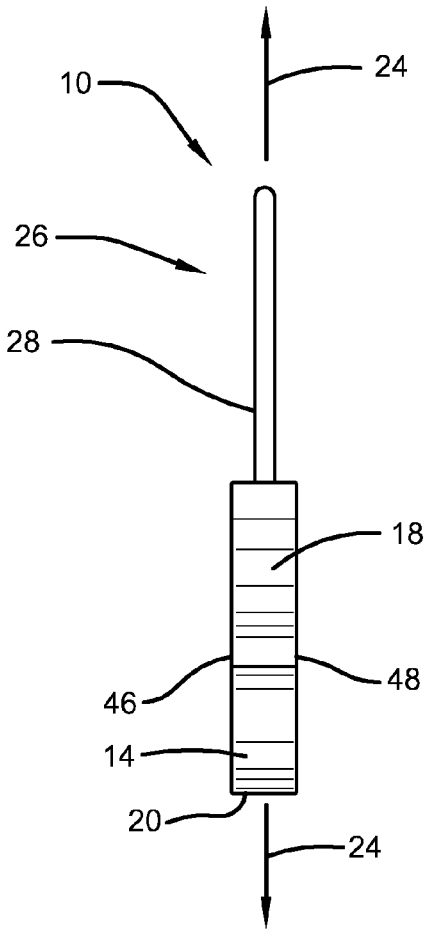
FIG. 5 is a right-side view of the hanger shown in FIGS. 1-4.
Figure 6:
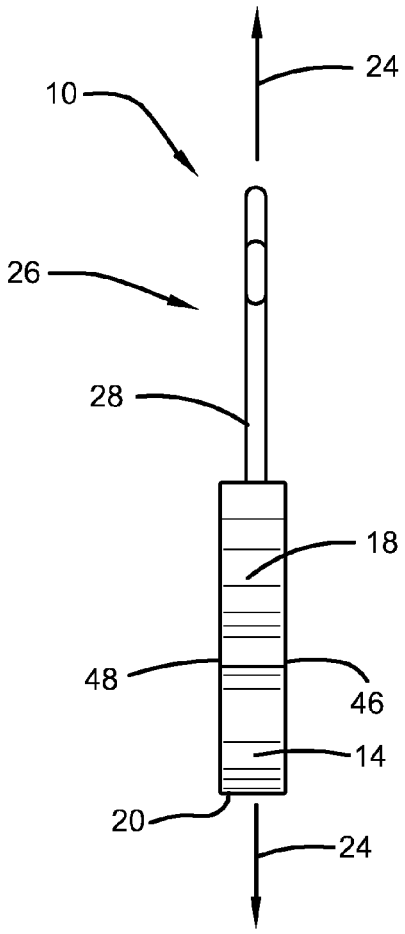
FIG. 6 is a left-side view of the hanger shown in FIGS. 1-5.

The hanger 10 can also include a bidirectional notch 38 extending into the unitary bar 12 from the bottom surface 20 at a position between the first and second opposite ends 14, 16. The bidirectional notch 38 can extend vertically for a first predetermined distance and laterally for a second predetermined distance. The first predetermined distance is referenced at 40 in FIG. 4. The second predetermined distance is referenced at 42 in FIG. 4. The first predetermined distance 40 and the second predetermined distance 42 can be substantially the same.

An upwardly-facing surface 44 can be defined by the bidirectional notch 38 along the second predetermined distance and be positioned lower than the first and second series of curved notches. The lowest portion of the undulations 34-334 and 36-336 is closer to the upper surface 18 along the axis 24 than the surface 44. This allows pants to be hung optimally. A middle belt loop of the pants can supported in a horizontal plane defined by the surface 44 that this lower than a horizontal plane defined by the bottom of the curved notches in which belt loops are supported at the first and second ends 14, 16. When the pants are hung with the hanger 10, the belt loops are thus arranged in an arc that is convex when viewed from below, with the middle of the pants slightly lower than the sides of the pants.

The hanger 10 can also include a tip 50 defined by the bidirectional notch 38. The lip 50 can be adjacent to the upwardly-facing surface 44. The lip 50 can have a top 52 positioned above the upwardly-facing surface 44 and lower than the first and second series of curved notches 30, 32. The shank 28 can extend along the axis 24. The upwardly-facing surface 44 can be substantially centered on the axis 24 relative to front and back surfaces 46, 48 of the unitary bar 12.

Figure 7:
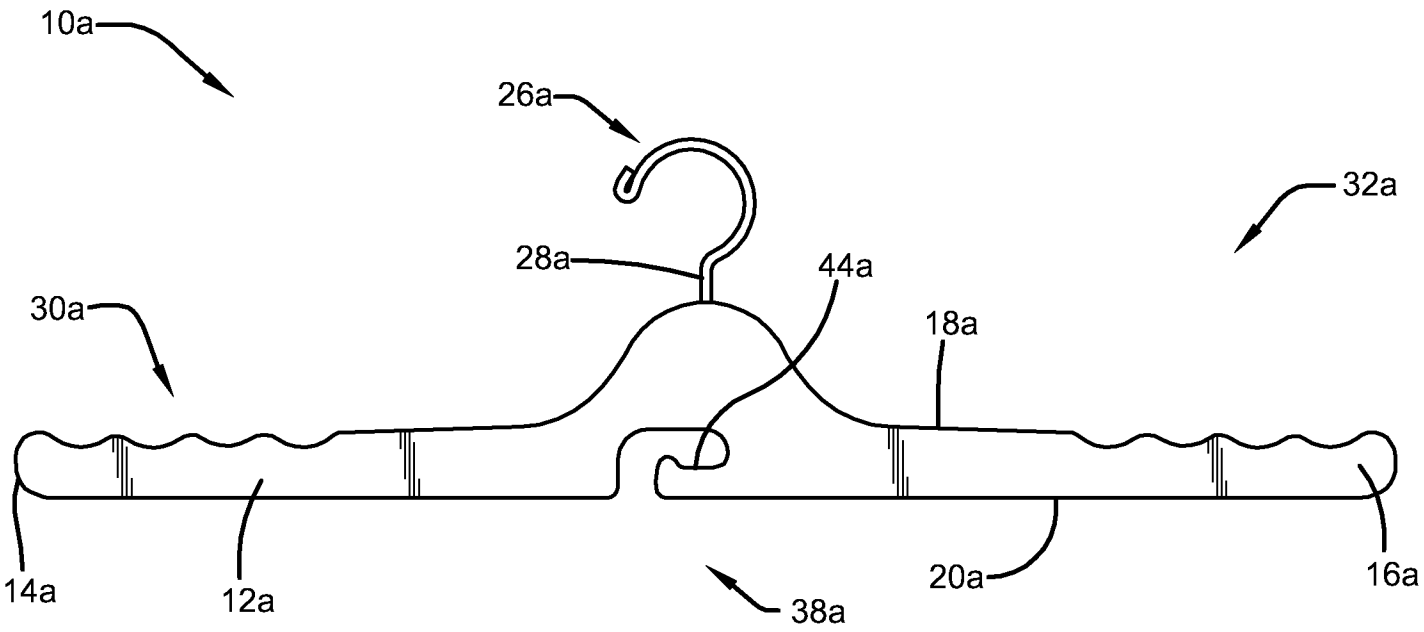
FIG. 7 is a front view of a hanger according to another exemplary embodiment of the present disclosure.

As shown in FIG. 7, in another embodiment of the present disclosure, a hanger can include a unitary bar 12*a* extending between first and second opposite ends 14*a*, 16*a* and between top and bottom surfaces 18*a*, 20*a*. The hanger 10*a* can also include a suspending member 26*a* having a shank fixed 28*a* to the unitary bar 12*a*. The hanger 10*a* can also include a first and second series 30*a*, 32*a* of curved notches respectively disposed at the first and second opposite ends 14*a*, 16*a*. The hanger 10*a* can also include a bidirectional notch 38*a* extending into the unitary bar 12*a* from the bottom surface 20*a* at a position between the first and second opposite ends 14*a*, 16*a*. The bidirectional notch 38*a* can extend vertically for a first predetermined distance and laterally for a second predetermined distance. An upwardly-facing surface 44*a* can be defined by the bidirectional notch 38*a* and is positioned lower than the first and second series of curved notches 30*a*, 32*a*. The second embodiment differs from the first embodiment in that the portion of the unitary bar 12*a* proximate to the shank 28*a* is more rounded than the portion of the unitary bar 12 proximate to the shank 28.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. Further, the "present disclosure" as that term is used in this document is what is claimed in the claims of this document. The right to claim elements and/or sub-combinations that are disclosed herein as other present disclosures in other patent documents is hereby unconditionally reserved.

What is claimed is:

1. In a hanger having:

a unitary bar extending between first and second opposite ends and between top and bottom surfaces, wherein said top surface faces upwardly and is uncovered;

a suspending member having a shank fixed to said unitary bar;

first and second series of undulations respectively disposed at said first and second opposite ends of said unitary bar in said top surface and thereby uncovered; and a bidirectional notch extending into said unitary bar from said bottom surface at a position between said first and second opposite ends as well as between said first and second series of undulations, said bidirectional notch initially extending vertically for a first predetermined distance from said bottom surface and laterally across said unitary bar for a second predetermined distance, wherein an upwardly-facing surface is defined by said bidirectional notch and is positioned lower than all of said first and second series of undulations.

2. The hanger of claim 1 wherein a lip is defined by said bidirectional notch adjacent to said upwardly-facing surface, said lip having a top positioned above said upwardly-facing surface and lower than said first and second series of undulations.

3. The hanger of claim 1 wherein said shank extends along an axis and said upwardly-facing surface is substantially centered on said axis.

4. The hanger of claim 1 wherein said first predetermined distance and said second predetermined distance are substantially the same.

* * * * *